US010436208B2

(12) United States Patent
Narayanan et al.

(10) Patent No.: US 10,436,208 B2
(45) Date of Patent: Oct. 8, 2019

(54) SURGE ESTIMATOR

(75) Inventors: Krishnan Narayanan, Urbandale, IA (US); Paul Reinke, Elkhart, IA (US)

(73) Assignee: ENERGY CONTROL TECHNOLOGIES, INC., Urbandale, IA (US)

( * ) Notice: Subject to any disclaimer, the term of this patent is extended or adjusted under 35 U.S.C. 154(b) by 1469 days.

(21) Appl. No.: 13/532,837

(22) Filed: Jun. 26, 2012

(65) Prior Publication Data

US 2012/0328410 A1 Dec. 27, 2012

Related U.S. Application Data

(60) Provisional application No. 61/501,311, filed on Jun. 27, 2011.

(51) Int. Cl.
*F04D 27/02* (2006.01)
*F04D 27/00* (2006.01)

(52) U.S. Cl.
CPC ..... *F04D 27/0207* (2013.01); *F04D 27/001* (2013.01)

(58) Field of Classification Search
CPC .... F04D 27/02; F04D 27/023; F04D 27/0207; F04D 27/0215; F04D 27/0223; F04D 27/0253; F04D 27/0261; F05D 2270/101; F05D 2270/1024
USPC .... 415/1, 13, 17, 26, 27, 29, 36, 42, 47, 49; 417/42, 43, 44.11, 295
See application file for complete search history.

(56) References Cited

U.S. PATENT DOCUMENTS 4,142,838 A * 3/1979 Staroselsky ..... 417/20
4,156,578 A * 5/1979 Agar et al. ..... 415/1
4,164,033 A * 8/1979 Glennon ..... F04D 27/0207 415/17
4,380,893 A * 4/1983 Stokes ..... F02C 9/18 415/27
4,428,194 A * 1/1984 Stokes ..... F02C 9/18 415/27
4,697,980 A * 10/1987 Keyes et al. ..... 415/1
4,831,534 A * 5/1989 Blotenberg ..... 701/100
4,831,535 A * 5/1989 Blotenberg ..... 701/100
(Continued)

FOREIGN PATENT DOCUMENTS

EP 0366219 A2 5/1990
EP 1444428 1/2009
(Continued)

*Primary Examiner* — Carlos A Rivera
*Assistant Examiner* — Wayne A Lambert
(74) *Attorney, Agent, or Firm* — Zarley Law Firm, PLC

(57) ABSTRACT

A method of correcting surge control parameters that includes providing a dynamic compressor having a compressor, driver, surge valve, and control system. The control system establishes surge control parameters such as surge detection lines, surge limit lines, and then detects the onset of a surge in the dynamic compressor. When the surge is detected the control system measures variables of the dynamic compressor such as fluid pressure, fluid speed, power, speed and valve position and based on these variables the control system automatically corrects the surge control parameters based on these variables at the time of the onset of the surge is detected. Advisory information is provided by control system to user for corrective actions to prevent surge.

18 Claims, 3 Drawing Sheets

(56) References Cited

U.S. PATENT DOCUMENTS

| | | | | |
|---|---|---|---|---|
| 4,936,741 | A * | 6/1990 | Blotenberg | F04D 27/0207 415/27 |
| 4,944,652 | A * | 7/1990 | Blotenberg | 415/27 |
| 4,949,276 | A * | 8/1990 | Staroselsky et al. | 700/282 |
| 4,971,516 | A * | 11/1990 | Lawless et al. | 415/1 |
| 5,306,116 | A * | 4/1994 | Gunn et al. | 415/27 |
| 5,347,467 | A * | 9/1994 | Staroselsky et al. | 700/282 |
| 5,508,943 | A * | 4/1996 | Batson et al. | 700/287 |
| 5,743,715 | A * | 4/1998 | Staroselsky | F04D 27/02 415/1 |
| 5,752,378 | A * | 5/1998 | Mirsky et al. | 60/773 |
| 6,317,655 | B1 | 11/2001 | Knots et al. | |
| 8,323,000 | B2 * | 12/2012 | Mirsky | F01D 15/08 417/295 |
| 2010/0287907 | A1 | 11/2010 | Agrawal et al. | |
| 2011/0093133 | A1 | 4/2011 | Turney et al. | |
| 2012/0183385 | A1 * | 7/2012 | Narayanan | F04D 27/0223 415/1 |

FOREIGN PATENT DOCUMENTS

| | | |
|---|---|---|
| EP | 2322877 | 5/2011 |
| JP | 6010885 | 1/1994 |

* cited by examiner

SURGE ESTIMATOR

CROSS REFERENCE TO RELATED APPLICATION

This application claims the benefit of U.S. Provisional Application No. 61/501,311 filed Jun. 27, 2011.

BACKGROUND OF THE INVENTION

This invention relates to a compressor control system. More specifically, this invention relates to a compressor surge control system for estimating, correcting and eliminating surge.

Compressor surge control systems, also known as anti-surge controllers, use a standard PID controller for regulating a recycle valve of the compressor when flow rate decreases below a predefined set point. The minimum set point for recycling is established based on rules of thumb and operating guidelines and is typically set at a fixed margin from the surge limit line. (or minimum flow set point).

A compressor surge line is defined by the compressor manufacturer consisting of several points for various operating conditions. The compressor surge line is typically a curve that is configured based on either field testing or calculated using the given performance maps. A mathematical function curve or a two dimensional lookup table is used to store the points defining the surge line of a compressor in computer memory. However, the compressor surge line can change due to variations in gas composition, suction temperature, speed, inlet geometry, and the like causing problems in the art.

As a result of this problem a surge point or surge line of a compressor is defined to account for variations in gas compositions, suction temperature, speed, inlet geometry, and the like. Currently in the art compressor surge controllers employ a surge parameter based on polytropic head and volumetric flow. Compressor surge is detected based on rate of change of compressor flow or discharge pressure to exceed a defined threshold or compressor operating point crossing the defined surge point or curve in the surge controller.

Still, problems remain with these types of controllers. Specifically, if the compressor surge point is not tested by the compressor vendor during shop testing then the surge line provided by the compressor manufacturer is typically an estimate of the actual surge point. Using an estimated surge point and not validating the curve in the field typically results in either the actual compressor surge point being to right or the left of the estimated curve provided by the vendor. In addition, the compressor surge line can shift due to performance degradation from impeller fouling, internal recycling, and inter-stage cooler plugging or due to significant changes in gas molecular weight or inlet temperature from the compressor design data. Therefore, any shifts in compressor performance can potentially lead to compressor surging and the surge control system must be able to detect the onset of surging and eliminate repetitive cycles of surging to occur.

Sometimes a compressor can also surge due to a stuck surge valve or incorrect control tuning parameters configured by the field engineers. Several continuous surge cycle events can lead to damage of the compressor due to bearing failures, temperature buildup, excessive vibration, impeller tip rubbing the housing, and over-speed. Existing surge control systems provide a trial and error method to correct for inaccurate surge line configuration or shifts in surge point. These methods are based on arbitrary increases in the surge control margin for each occurrence of surge cycle detection to alleviate surge condition. As a result, if the required correction to surge margin is set incorrectly then multiple cycles of surging can result and potentially damage the compressor. It is also possible that required correction to surge margin is excessive, thereby causing excessive recycling and process upsets. Moreover, there are no defined guidelines available to a field engineer to configure the required correction margin if a compressor surges to the right of the surge line defined in the controller.

Therefore, a principal object of the present invention is to provide an improved control system for a dynamic compressor that accounts for actual operating conditions of a compressor.

Yet another object of the present invention is to provide an improved control system that minimizes surge within a compressor.

These and other objects, features, or advantages will become apparent from the specification and claims.

BRIEF SUMMARY OF THE INVENTION

A method of correcting surge control parameters of a dynamic compressor. This method includes providing a dynamic compressor that has a compressor with a gas inlet and gas outlet. The dynamic compressor additionally includes a compressor driver that is mechanically connected to the compressor and a surge valve that is fluidly connected between the gas inlet and the gas outlet of the compressor. The dynamic compressor additionally includes a control system that is in electric communication with the components of the dynamic compressor. The next step of the method is establishing surge control parameters with the control system. The control system then detects the onset of a surge in the dynamic compressor based on the established surge control parameters. At the time the onset of the surge is detected the control system measures variables of the dynamic compressor and then automatically corrects the surge control parameters based upon the variables measured at the time onset of the surge was detected. Advisory information will be provided to user for corrective actions to prevent surge.

DETAILED DESCRIPTION OF THE PREFERRED EMBODIMENT

Figure 1:
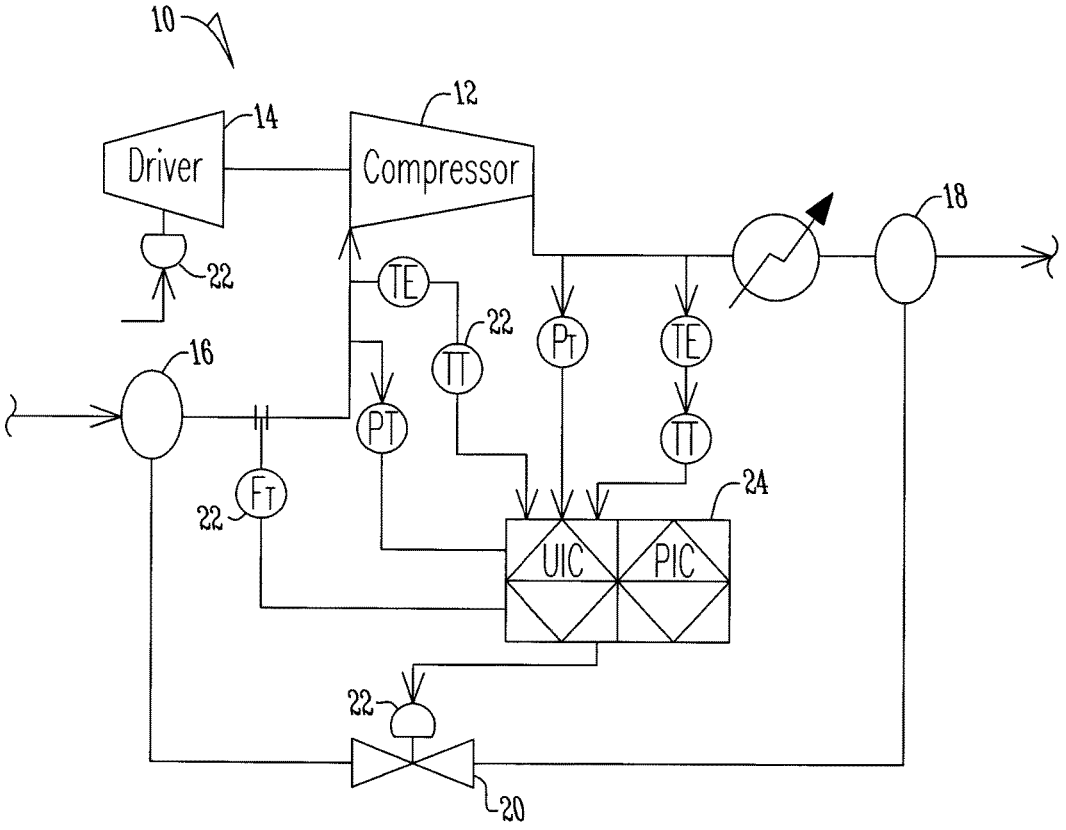
FIG. 1 is a schematic diagram of a dynamic compressor.

FIG. 1 shows a dynamic compressor 10 that includes a compressor 12 that is driven by a compressor driver 14. The compressor driver is of any type including a motor, gas turbine, steam turbine or the like. The compressor 12 has a gas inlet 16 and a gas outlet 18 wherein gas flows through the compressor 12 to be compressed. A surge or recycle valve 20 is fluidly connected between the gas inlet 16 and gas outlet 18 so that when the surge valve 20 opens a fluid flow path exists to convey gas from the gas outlet 18 to the gas inlet 16. A plurality of sensors 22 including pressure sensors, temperature sensors, flow measurement sensors and the like are placed throughout the dynamic compressor 10 in order to determine processed conditions for the components of the dynamic compressor including the compressor 12, the driver 14, the gas inlet 16, gas outlet 18 and the surge valve 20. The plurality of sensors 22 are electrically connected to the control system 24 where the control system is in real time communication with all of the components of the dynamic compressor and controls the opening of the surge valve 20.

The control system 24 has an automatic surge estimator that uses a compressor load variable in order to detect the onset of a surge. Specifically, compressor surge can be detected by the estimator based on a compressor dynamic operating point such as a function of surge limit line, rate of change of compressor driver power (where driver could be a motor, steam, or gas turbine) or rotating speed, mathematical modeling of a compressor, driver and associated process, rate of change of compressor flow, rate of change of discharge or suction pressure, rate of change of temperature, a combination of any of the previous detection methods, or the like.

Figure 2:
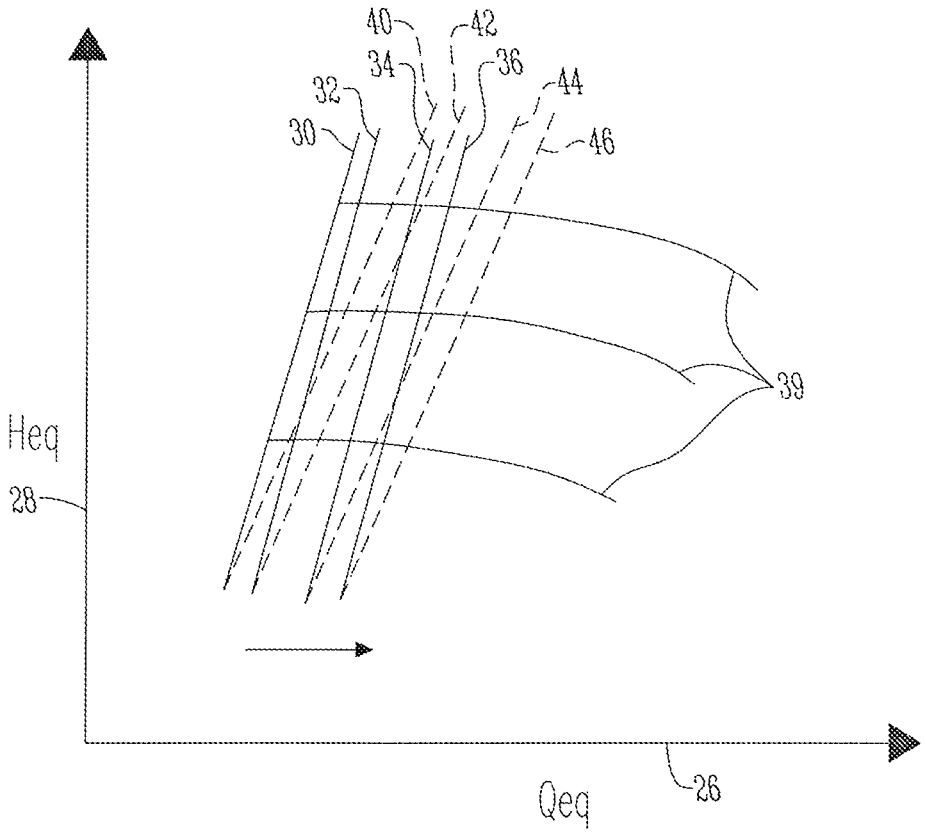
FIG. 2 is a graph where the X axis represents flow equivalent variable shown by Qeq and the Y axis represents head equivalent variable shown by Heq.

As indicated in FIG. 2, upon detection of the surge the estimator measures variables of the compressor such as fluid flow, pressure, speed, temperature, inlet guide vane position, surge valve position and the like in order to estimate the location of a corrected surge point. Then, based on this revised surge point the control parameters of the surge controllers are corrected in order to prevent multiple surge occurrences. These surge control parameters include surge point or points, surge control margin, control tuning parameters, a combination of these, and the like.

In particular, FIG. 2 shows a graph of the output of the dynamic compressor 10. On the X axis 26 the variable shown as Qeq (flow equivalent variable) is measured against variable Heq (head equivalent variable) shown on the Y axis 28. Qeq variable is typically compressor volumetric flow normalized to sonic velocity of gas at flowing conditions in suction. Heq variable is typically compressor pressure ratio or polytropic head normalized to sonic velocity of gas at flow conditions. Line 30 represents the surge detector line while line 32 represents the surge limit line, line 34 represents surge preventer line, and line 36 represents the surge control line. The curved lines 39 represent individual compressor performance curves at different operating speeds or inlet geometry position. Once a surge is detected by the control system 24 new surge line 42 is calculated based on measured variables at the time of the surge occurrence thus causing the control parameters to be recalibrated by the control system 24. Control system 24 will automatically correct the control parameters such as control tuning parameters and provide advisory information in the form of data recording files or graphical representation of compressor performance maps to user for corrective action to avoid surging of compressor. Automatically is understood to mean without human intervention. Advisory information is understood to mean providing required data to user for corrective action. Lines 30, 32, 34, and 36 depict the control parameters before surge estimator and correction. Lines 40, 42, 44 and 46 depict the control parameters after surge estimator and correction. That is, line 40 depicts the corrected surge detector line 30; line 42 depicts the corrected surge limit line 32; line 44 depicts the corrected surge preventer line 34; and line 46 depicts the corrected surge control line 36.

Figure 3:
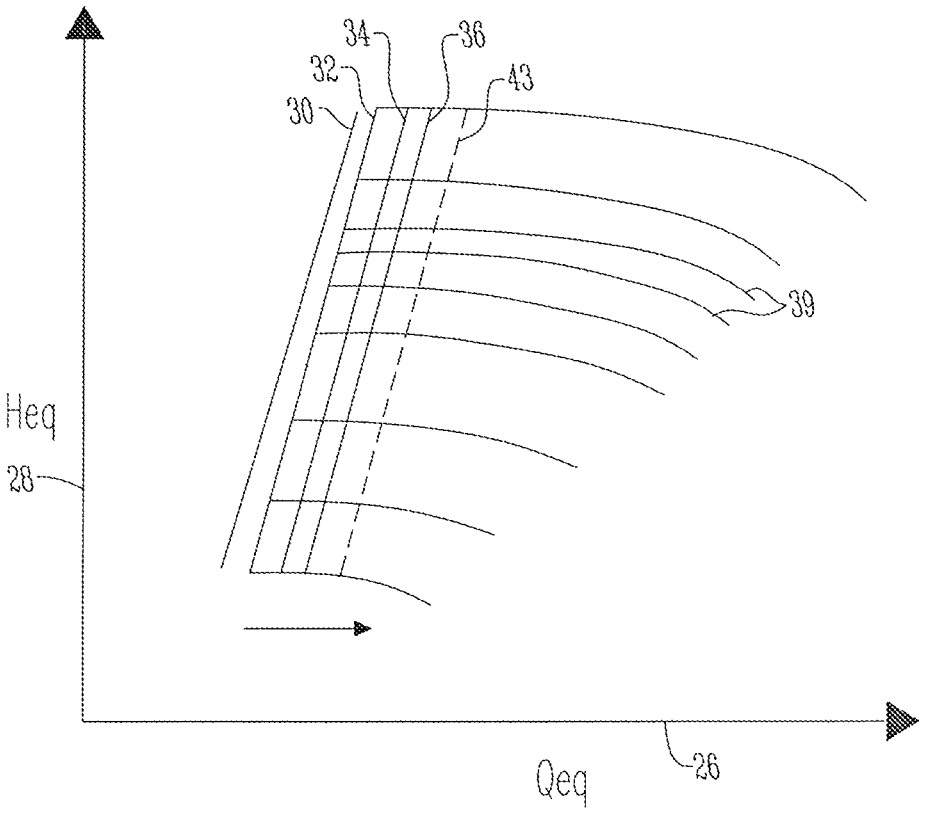
FIG. 3 is a graph where the X axis represents flow equivalent variable shown by Qeq and the Y axis represents head equivalent variable shown by Heq.

FIG. 3 is same as 2.0 with the exception that instead of estimating a new surge line 42 at the time of surge occurrence, a new surge control margin 43 is calculated based on measured variables at the time of surge occurrence.

In operation, the estimator of the control system thus monitors the dynamic compressor in order to detect the onset of surge. Based on the detection of a surge the estimator then estimates a corrected surge point based on measured variables and resets other control parameters accordingly in order to provide a more accurate and dynamic representation of the dynamic compressor within the control system.

Thus, provided is an improved control system for a dynamic compressor that accounts for actual operating conditions of a compressor in determining an estimated surge point in order to adapt surge parameters according to the actual operation of a dynamic compressor. This method and control system eliminates the need to arbitrarily increase the surge control margin and maximizes protection for the dynamic compressor. Thus, at the very least all of the problems discussed in the Background are overcome.

What is claimed:

1. A method of correcting surge control parameters of a dynamic compressor steps comprising:

providing a dynamic compressor having a compressor with a gas inlet and a gas outlet, a compressor driver connected to the compressor, a surge valve fluidly connected between the gas inlet and the gas outlet of the compressor, and a control system having a proportional integral derivative controller (PID) with an automatic surge estimator in electric communication with the compressor;

establishing surge control parameters with the control system, wherein the surge control parameters include a surge detector line, a surge limit line, a surge preventer line, and a surge control line;

detecting the onset of a surge in the dynamic compressor with the control system;

measuring variables of the dynamic compressor with the control system at the time the onset of the surge is detected; and automatically correcting the at least one surge control parameters with the control system based upon the variables measured at the time the onset of the surge is detected.

2. The method of claim 1 wherein the onset of the surge in the dynamic compressor is detected using compressor variables measured and recorded by the control system on a continuous basis.

3. The method of claim 2, wherein onset of surge is determined based on mathematical modeling of a compressor.

4. The method of claim 2, wherein onset of surge is determined based on compressor load variable.

5. The method of claim 2, wherein onset of surge is determined based on rate of change of driver power.

6. The method of claim 2, wherein onset of surge is determined based on rate of change of rotating speed.

7. The method of claim 2, wherein onset of surge is determined based on rate of change of compressor flow or pressure or temperature.

8. The method of claim 1 wherein the variables are selected from a group consisting of fluid flow rate, fluid pressure, compressor speed, driver power fluid temperature, inlet guide vane position and surge valve position.

9. The method of claim 1 wherein onset of surge is detected based on compressor operating point rate of change.

10. The method of claim 1, wherein advisory information is provided to user for correction of control parameters.

11. The method of claim 1, wherein advisory information is provided in the form of data recording files.

12. The method of claim 1, wherein advisory information is provided in the form of graphical representation of compressor performance maps.

13. The method of claim 1, wherein a controller estimates and corrects a surge control margin.

14. The method of claim 1, wherein a controller estimates and corrects control tuning parameters.

15. The method of claim 1 wherein the control system defines a surge detector line.

16. The method of claim 1 wherein the control system automatically corrects the surge preventer line.

17. The method of claim 15 wherein the control system automatically corrects the surge detector line.

18. The method of claim 1 wherein compressor surge is detected based on the detected compressor operating point as a function of a surge limit line.

* * * * *